US012644229B2

(12) United States Patent
Van Pelt et al.

(10) Patent No.: US 12,644,229 B2
(45) Date of Patent: Jun. 2, 2026

(54) SEAL STRIP WEAR MONITORING SYSTEMS AND ASSEMBLIES THEREFOR

(71) Applicant: Andritz Inc., Alpharetta, GA (US)

(72) Inventors: Wesley C. Van Pelt, Appleton, WI (US); Christopher Mason, Bunker Hill, WV (US); Brandon Kilbourne, Appleton, WI (US); Jacob Speckman, Neenah, WI (US)

(73) Assignee: Andritz Inc., Alpharetta, GA (US)

( * ) Notice: Subject to any disclaimer, the term of this patent is extended or adjusted under 35 U.S.C. 154(b) by 93 days.

(21) Appl. No.: 18/420,843

(22) Filed: Jan. 24, 2024

(65) Prior Publication Data

US 2024/0254693 A1 Aug. 1, 2024

Related U.S. Application Data

(60) Provisional application No. 63/481,835, filed on Jan. 27, 2023.

(51) Int. Cl.
*D21F 7/00* (2006.01)
*D21F 3/10* (2006.01)

(52) U.S. Cl.
CPC . *D21F 7/00* (2013.01); *D21F 3/10* (2013.01)

(58) Field of Classification Search
CPC .... F16J 15/3492; F16J 15/3496; F16J 15/064; D21F 7/00; D21F 3/10
See application file for complete search history.

(56) References Cited

U.S. PATENT DOCUMENTS

| | | | | |
|---|---|---|---|---|
| 6,065,345 | A * | 5/2000 | Holenstein | F04D 29/128 73/660 |
| 6,358,370 | B1 | 3/2002 | Huttunen | |
| 7,551,288 | B1 * | 6/2009 | Discenzo | G01B 9/02027 356/477 |
| 10,179,973 | B2 | 1/2019 | Keinberger et al. | |
| 10,184,214 | B2 * | 1/2019 | Keinberger | D21F 3/02 |
| 11,441,270 | B2 | 9/2022 | Eckerstorfer et al. | |

(Continued)

FOREIGN PATENT DOCUMENTS

| | | | |
|---|---|---|---|
| AT | 524227 | B1 | 4/2022 |
| WO | 2022103609 | A1 | 5/2022 |

OTHER PUBLICATIONS

International Search Report and Written Opinion corresponding to PCT/US2024/012672, May 28, 2024, (8 pages).

(Continued)

*Primary Examiner* — Eugene G Byrd
(74) *Attorney, Agent, or Firm* — Myers Bigel, P.A.

(57) ABSTRACT

A seal strip and wear monitoring system includes: a seal strip having an upper surface; and a wear monitoring system. The wear monitoring system includes: a sensing portion comprising a plurality of electrical traces, each of the electrical traces including an uppermost portion that is generally parallel with and is positioned at a depth from the upper surface of the seal strip, wherein the depth of each trace uppermost portion differs from the depth of the other electrical traces; and a signal processing portion electrically connected with the electrical traces, the signal processing portion including circuitry configured to detect electrical signals from the traces and to determine when the uppermost portion of a trace has been damaged.

20 Claims, 11 Drawing Sheets

(56) References Cited

U.S. PATENT DOCUMENTS

| | | | | |
|---|---|---|---|---|
| 11,732,414 | B2 * | 8/2023 | Kilbourne | D21G 9/0036 162/263 |
| 2004/0075218 | A1 * | 4/2004 | Heinzen | F16J 15/3296 277/321 |
| 2005/0126732 | A1 * | 6/2005 | Gleason, Jr. | D21F 3/10 162/371 |
| 2010/0127460 | A1 * | 5/2010 | Bennett | F16J 15/064 277/592 |
| 2010/0171269 | A1 * | 7/2010 | Prellwitz | F16J 15/3492 277/317 |
| 2011/0239749 | A1 * | 10/2011 | Toth | F16J 15/0818 73/114.18 |
| 2012/0119448 | A1 * | 5/2012 | Stewart | G01N 27/22 277/650 |
| 2013/0213879 | A1 * | 8/2013 | Petschauer | D21F 3/10 210/386 |
| 2015/0184340 | A1 * | 7/2015 | Erkelenz | D21F 3/10 162/374 |
| 2018/0112779 | A1 * | 4/2018 | Nahrwold | F16J 15/3296 |
| 2018/0119355 | A1 | 5/2018 | Erkelenz et al. | |
| 2018/0313035 | A1 | 11/2018 | Reaves et al. | |
| 2019/0078972 | A1 * | 3/2019 | Sitko | G01M 13/005 |
| 2020/0318740 | A1 * | 10/2020 | Guo | F16J 15/3492 |
| 2021/0087747 | A1 | 3/2021 | Erkelenz | |
| 2021/0189653 | A1 | 6/2021 | Eckerstorfer et al. | |
| 2022/0333306 | A1 * | 10/2022 | Erkelenz | D21F 5/143 |
| 2022/0403935 | A1 * | 12/2022 | Lauer | F16J 15/3296 |
| 2023/0287977 | A1 * | 9/2023 | Kottkamp | F16J 15/064 |
| 2024/0254693 | A1 * | 8/2024 | Van Pelt | D21F 7/00 |

OTHER PUBLICATIONS

"International Preliminary Report on Patentability corresponding to International Application No. PCT/US2024/012672 mailed Aug. 7, 2025".

* cited by examiner

SEAL STRIP WEAR MONITORING SYSTEMS AND ASSEMBLIES THEREFOR

RELATED APPLICATION

The present application claims priority from and the benefit of U.S. Provisional Patent Application No. 63/481,835, filed Jan. 27, 2023, the disclosure of which is hereby incorporated herein by reference in full.

FIELD

The present invention is directed generally to papermaking, and more specifically to suction rolls and equipment within a papermaking machine.

BACKGROUND

Paper manufacturing inherently requires at many points in the production process the removal of water. In general, the paper pulp (slurry of water and wood and other fibers) rides on top of a felt (in the form of a wide belt) which acts as a carrier for the wet pulp before the actual sheet of paper is formed. Felts are used to carry the pulp in the wet section of the paper machine until enough moisture has been removed from the pulp to allow the paper sheet to be processed without the added support added by the felt.

Quite commonly on the wet end of a paper machine, initial water removal is accomplished using a suction roll in a press section (be it a couch, pickup, or press suction roll) used in conjunction with a standard press roll without holes (or against a Yankee dryer in a tissue machine) that mates in alignment with the suction roll. The felt pulp carrier is pressed between these two rolls.

The main component of a suction roll 10 includes a hollow shell 12 (FIG. 1) made of stainless steel, bronze or other metal that has tens of thousands of holes, drilled in a prescribed pattern radially around the circumference of the roll. These holes are gauged in size (ranging from under ⅛" to nearly ¼") and are engineered for the particular paper material to be processed. It is these holes that form the "venting" for water removal. This venting can typically range from approximately 20 to 45 percent of the active roll surface area. The suction roll shell is driven by a drive system that rotates the shell around a stationary core called a suction box.

The suction box 20 (FIG. 2) can be thought of as conventional long rectangular box without a lid on the top and with ports on the end, bottom or sides. The end (specifically the drive end) of the box typically has a pilot bearing, of which the inner raceway is a pilot bushing or bearing with a slip fit to a journal on the suction box and the outer raceway is pressed onto the rotating shell. The suction box 20 is connected with a suction source (e.g., a vacuum pump). An exemplary suction box and shell are shown in U.S. Pat. No. 6,358,370 to Huttunen, the disclosure of which is hereby incorporated herein in its entirety.

In order to take advantage of the holes in the shell, a vacuum zone 30 must be created using these ports on the inside of the suction roll shell in a zone that is directly underneath the paper pulp that is being processed. This is accomplished by the suction box 20 using a slotted holder 32 which holds a seal along the long axis of the suction box on both sides. FIG. 2 shows the slotted holders 32, and FIGS. 3 and 4 show two varieties of seals 34, 34' which are in the form of strips (hereinafter "seal strips"). In addition to these long seals there are two shorter seals (called end deckles) on the short ends (called tending and drive ends) that permit some axial adjustment as needed to accommodate various sheet widths.

The seal strips 34, 34' are usually made of rubberized polymerized graphite and are held nearly in contact with the inner surface of the shell 12 during operation (see FIGS. 3 and 4). Between the seal strips 34, 34' a constant vacuum is drawn. This allows the vacuum zone 30 to be created underneath the sheet 40 as is passes over the roll 10. The seal strips 34, 34' are biased upwardly toward the suction roll shell 12 by load tubes 42, which are sealed hoses that run underneath the entire length of the seal strip 34, 34'. Pressure in the load tube 42 expands the load tube 42 (much like air in a balloon) and lifts the seal strip 34, 34' toward the inside surface of the shell 12. This effect, along with help from the system vacuum from the suction box 20 and the laminar flow of lubrication water mentioned previously, forms the seal between the edge of the seal strip 34 and the inside of the shell 12.

In actual application, in a properly functioning suction roll the seal strips 34, 34' never directly contact the inside of the suction roll shell 12. If the seal strips 34, 34' were to contact the shell 12 they would wear away and would quickly lose their sealing ability. In order to eliminate or significantly reduce this wear and to provide a seal, water is applied along the length of the seal strips 34, 34' with a lubrication shower formed with water flowing through a spray nozzle 24 (see FIG. 2). This shower keeps the seal strips 34, 34' lubricated with a laminar flow of water between the seal surface and the inside surface of the shell 12.

The amount of water used for lubrication should be gauged properly so that the proper amount of lubrication is applied to keep the seal strips 34, 34' lubricated, but not so much to either become an issue for the pulp being processed or to be wasting water. In addition, process water used in a paper mill may contain chemicals and also significant particulates that may clog the lubrication shower nozzles 24 during normal operation. Since these nozzles 24 are located inside the rotating shell 12 they are not visible to the paper machine operator.

Seal strips are typically replaced periodically after some degree of wear occurs. However, because the seal strips inside a suction roll are not visible to the operator of the paper making equipment or to anyone trying to view the seal strips, many conditions inside an operating suction roll, including the degree of seal strip wear, are unknown. As such, a reliable method of detecting seal strip wear to inform the operator of the paper making equipment that maintenance is needed on the equipment before a failure occurs may be desirable.

SUMMARY

As a first aspect, embodiments of the invention are directed to a seal strip and wear monitoring system. The system comprises a seal strip having an upper surface and a wear monitoring system. The wear monitoring system comprises: a sensing portion comprising a plurality of electrical traces, each of the electrical traces including an uppermost portion that is positioned at a depth from the upper surface of the seal strip, wherein the depth of each trace uppermost portion differs from the depth of the uppermost portions of the other electrical traces; and a signal processing portion electrically connected with the electrical traces, the signal processing portion including circuitry configured to detect electrical signals from the traces and to determine when the uppermost portion of a trace has been damaged.

As a second aspect, embodiments of the invention are directed to a seal strip monitoring system comprising: a seal strip having an upper surface; a printed circuit board (PCB) having first and second fingers and a main panel; a wear monitoring system; and a temperature monitoring system at least partially mounted on the PCB. The wear monitoring system comprises: a sensing portion comprising a plurality of electrical traces, each of the electrical traces including an uppermost portion that is generally parallel with and is positioned at a depth from the upper surface of the seal strip, wherein the depth of each trace uppermost portion differs from the depth of the uppermost portions of the other electrical traces, wherein the uppermost portions of the electrical traces are located on the first finger; and a signal processing portion electrically connected with the electrical traces, the signal processing portion including circuitry mounted on the main panel of the PCB and configured to detect electrical signals from the traces and to determine when the uppermost portion of a trace has been damaged.

DETAILED DESCRIPTION

Figure 1:
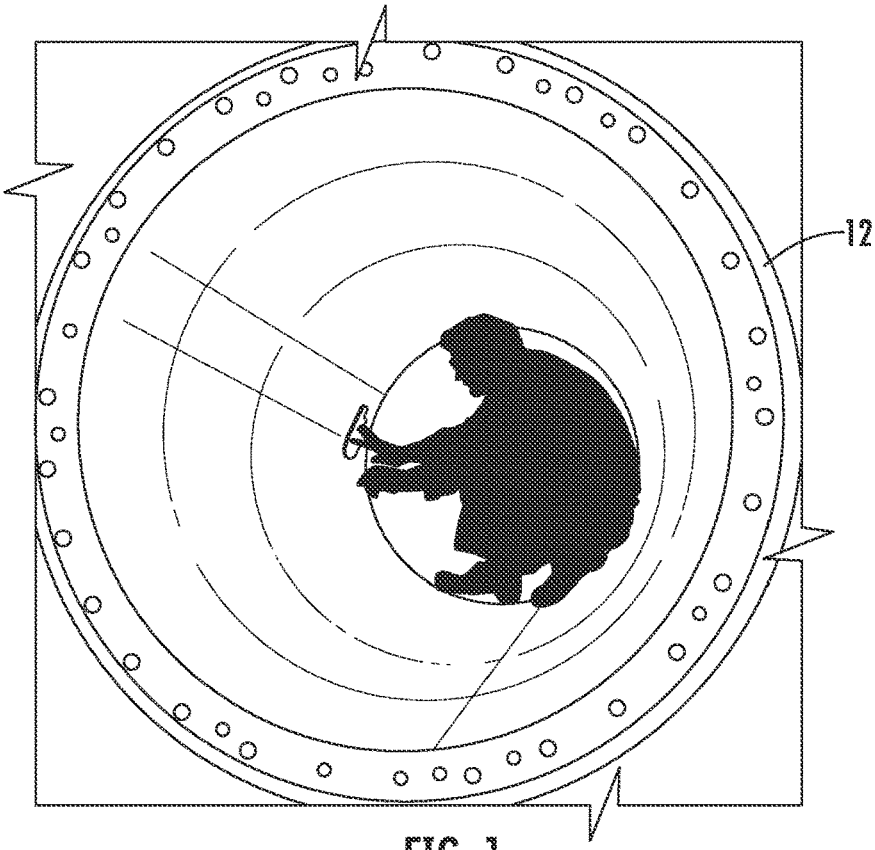
FIG. 1 is a perspective end view of a typical paper machine suction roll.
Figure 2:
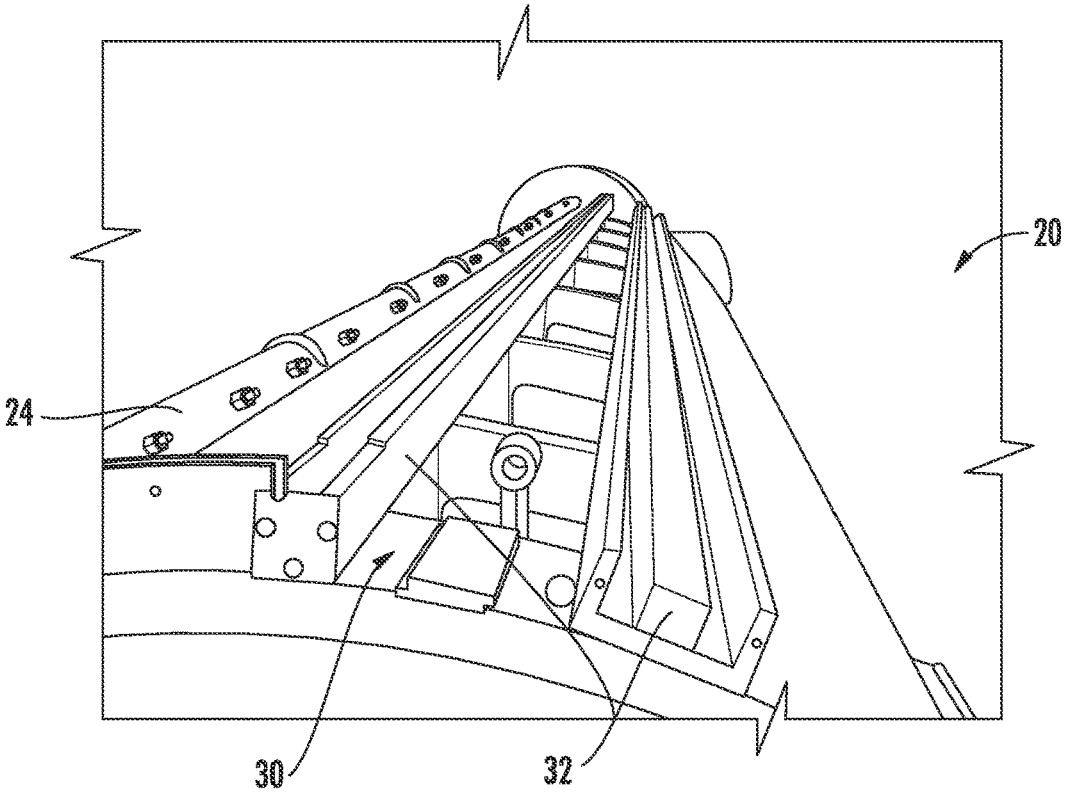
FIG. 2 is an enlarged perspective end view of the suction box area of a typical suction roll.
Figure 3:
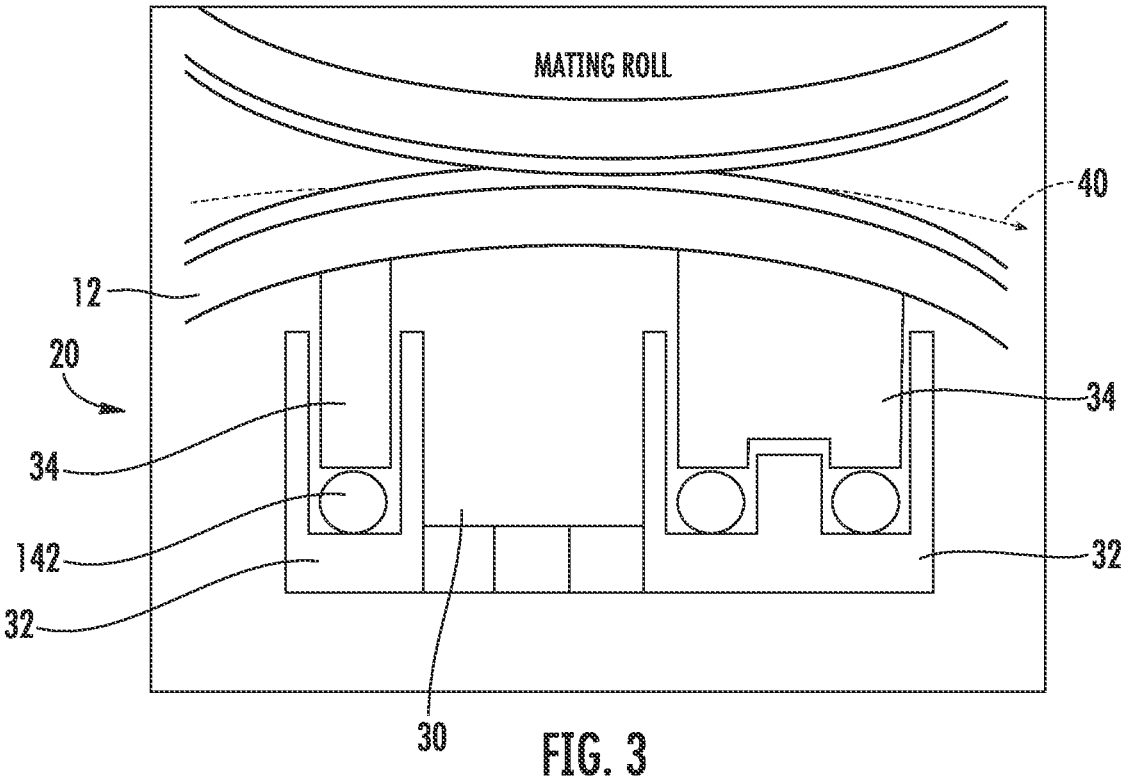
FIG. 3 is an end view of the suction box area and seal strips of a conventional suction roll.
Figure 4:
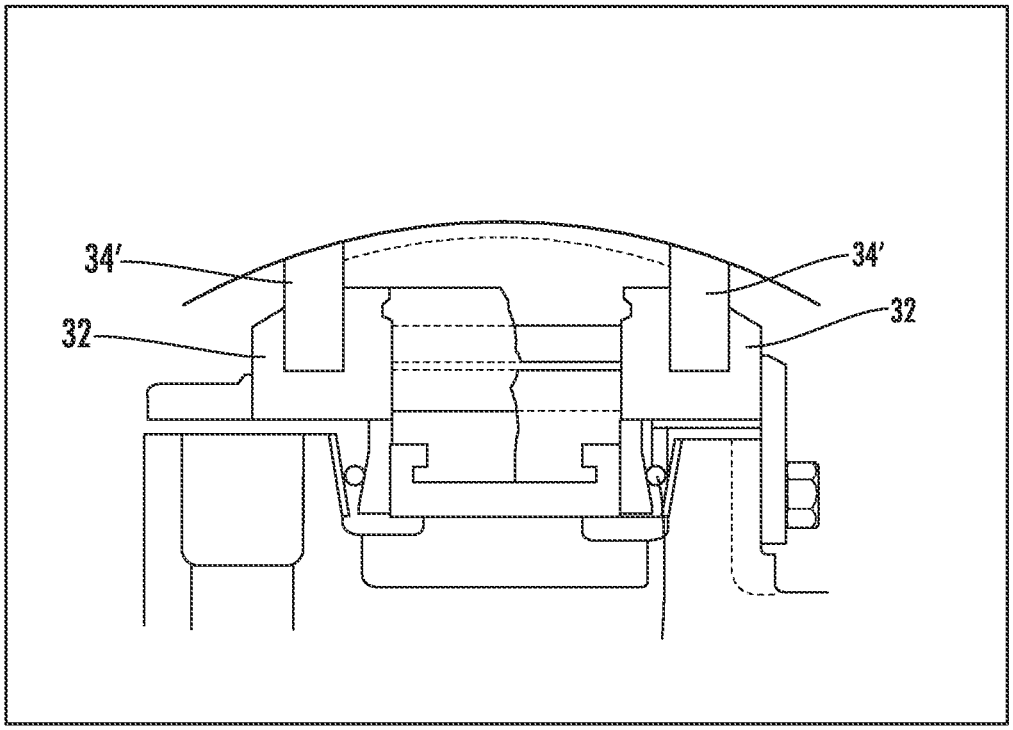
FIG. 4 is an end view of the suction box area and seal strips of another conventional suction roll.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

In addition, spatially relative terms, such as "under", "below", "lower", "over", "upper" and the like, may be used herein for case of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Referring now to the drawings, a seal strip 100 and an accompanying wear monitoring system 120 are shown in FIGS. 5-8. With the exception of accommodations for the wear monitoring system 120 described below, the seal strip 100 is of conventional design much in the manner described above: it is elongate and of generally constant cross-section; it resides within a channel-shaped holder and is supported by load tubes against its lower surface 105; the load cells bias the seal strip 100 upwardly (i.e., toward the shell of a suction roll) so that its upper surface 106 confronts the shell and contributes to a seal therewith; and it is formed of a polymeric material such as rubber (which may be filled with a filler, such as graphite).

Figure 5:
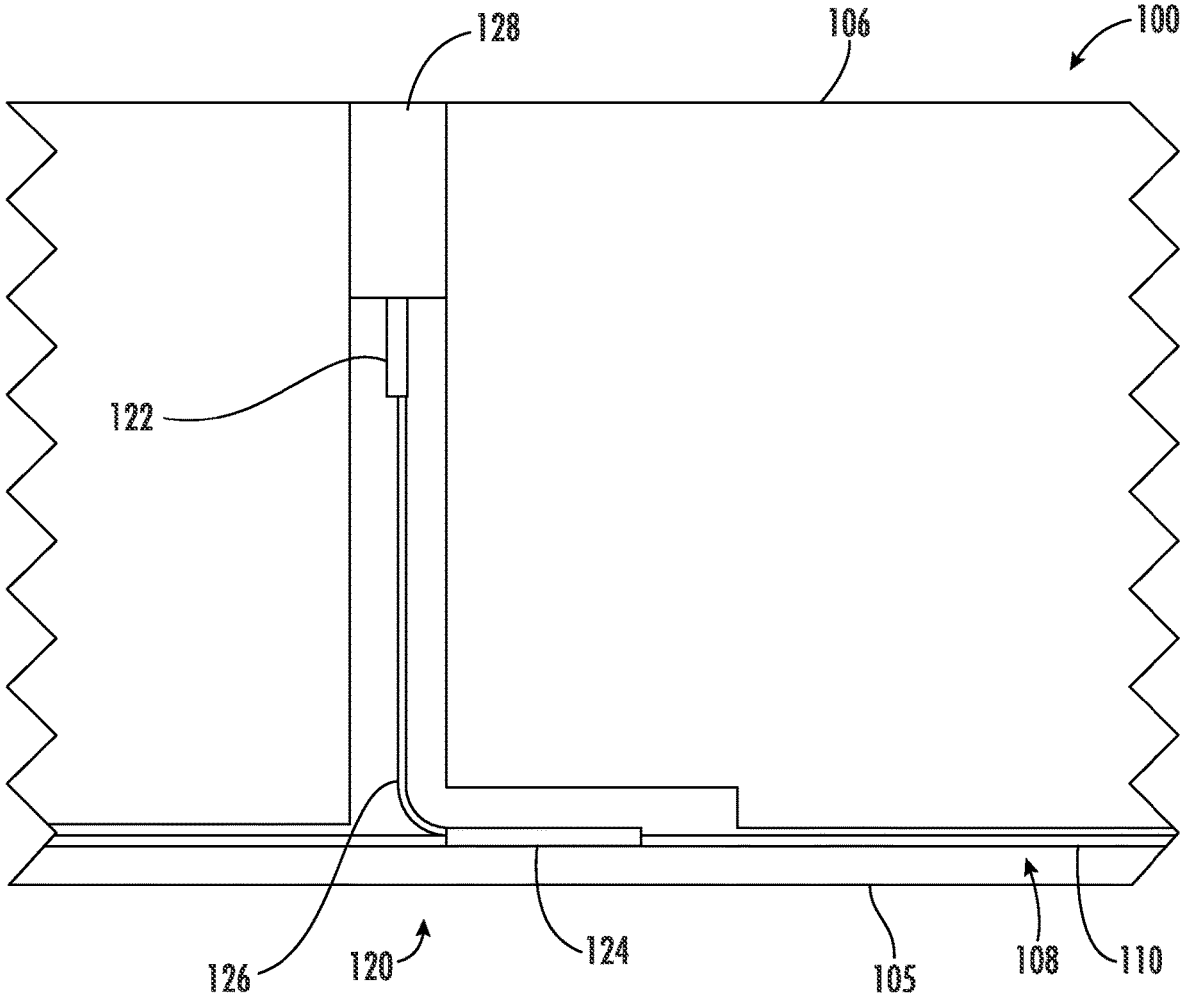
FIG. 5 is a schematic side view of a seal strip and wear monitoring system according to embodiments of the invention.

Referring now to FIG. 5, the wear monitoring system 120 is shown embedded within the seal strip 100. The wear monitoring system 120 includes a sensing portion 122, a signal processing portion 124, and cables 126 that connect the sensing portion 122 with the signal processing portion 124. The seal strip 100 includes a channel 108 in the lower surface in which cables 110 between adjacent wear monitoring systems 120 are routed. Also, a cap 128 surrounds the upper end of the sensing portion 122 and is flush with the upper surface 106 of the seal strip 100.

Figure 6:
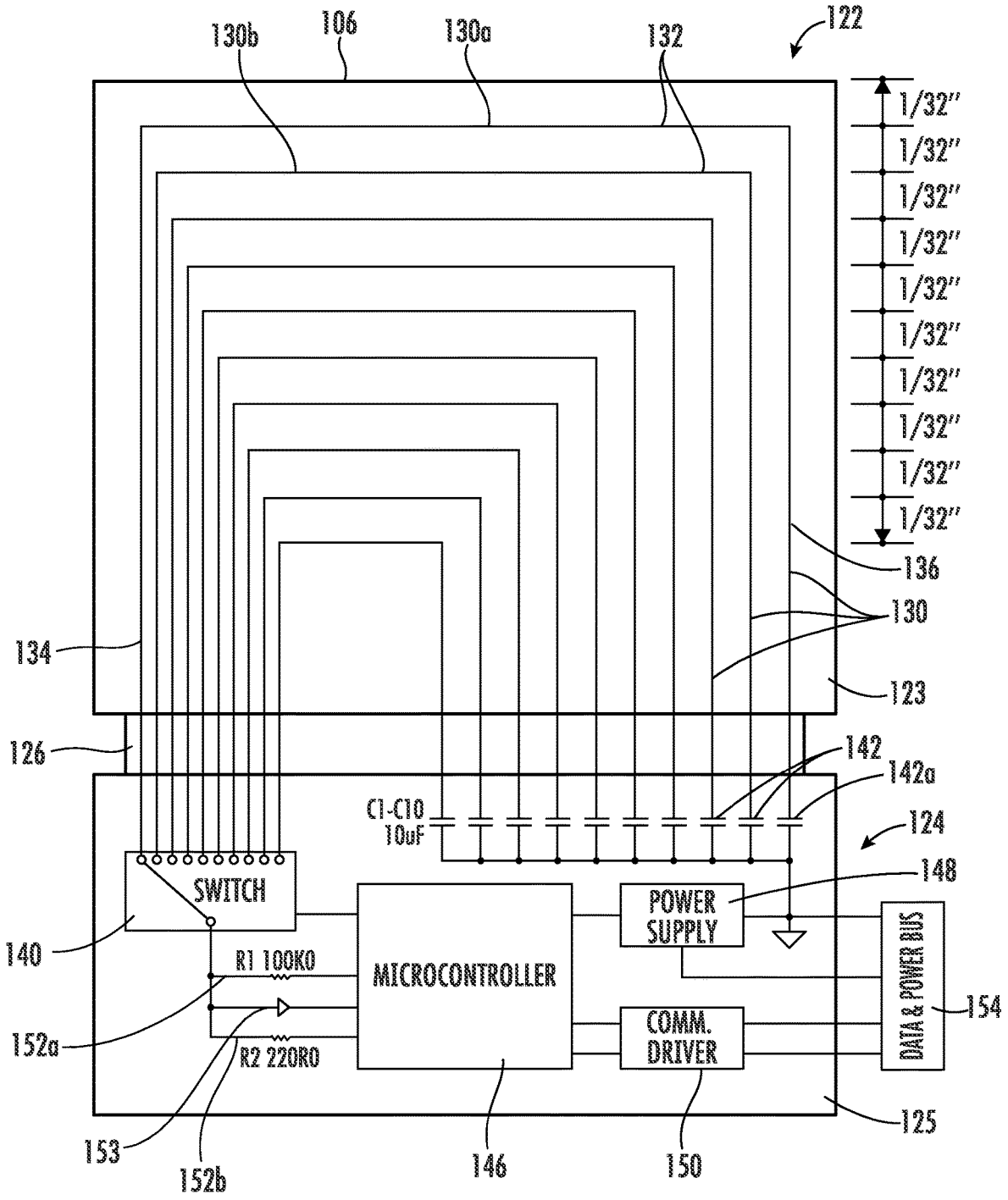
FIG. 6 is a schematic view of the wear monitoring system of FIG. 5.

Referring now to FIG. 6, the sensing portion 122 is typically comprises a printed circuit board (PCB) 123 with traces 130 (discussed in greater detail below). The signal processing portion 124 typically comprises a PCB 125 with processing components (also discussed in greater detail below). Also, although shown herein as separate PCBs, the sensing portion 122 and the signal processing portion 124 may be formed on the same PCB (see, e.g., system 420 shown in FIGS. 11-12D below).

Referring now to FIG. 6, the wearing monitoring system 120 is shown schematically. The sensing portion 122, shown in the top of FIG. 6, includes a plurality of electrical traces 130 on the PCB 123. As can be seen in FIG. 6, the traces 130 are laid out on the PCB 123 as a series of generally U-shaped lines, with the upper horizontal "run" 132 of each trace 130 (the uppermost portion of each trace 130) being separated from the adjacent upper runs 132 by a distance, such that the upper runs 132 are spaced from each other (in some embodiments they may be evenly or regularly spaced, e.g., by 1/32 inch in this example), and with each at a different "depth" (i.e., distance from the upper surface 106 of the seal strip 100). One of vertical runs 134 of each trace 130 is connected (through the cables 126) to a switch 140 on the PCB 125 of the signal processing portion 124, and the other of the vertical runs 136 of each trace 130 is connected (also through the cables 126) to a respective capacitor 142 mounted on the PCB 125. (It should be understood that in some embodiments the capacitors 142 may be mounted at or near the traces 130 themselves).

Still referring to FIG. 6, the signal processing portion 124 also includes a microcontroller 146, a power supply 148, and a communications driver 150. The switch 140 is connected to the microcontroller 146 both directly and via parallel charge and discharge resistors 152*a*, 152*b* and a sampling buffer 153. The microcontroller 146 is connected to the power supply 148 and to the communications driver 150. Both the power supply 148 and the communications driver 150 are connected with a data and power bus 154. Also, all of the capacitors 142 are connected in parallel and to ground.

The wear monitoring system 120 operates by repeatedly sampling the individual traces 123 and their corresponding capacitors 142. When a direct connection between the charge resistor 152*a* and a capacitor 142 is created, the capacitor 142 begins to charge. The relationship can be understood as $$Vc = Vs\left(1 - e^{-\frac{t}{\tau}}\right)$$

and $$\tau = RC$$

Wherein:

- Vc is the voltage potential across the capacitor in volts with reference to a common ground;
- Vs is the voltage potential of the supply in volts with reference to a common ground;
- e is Euler's number, an irrational number presented in this disclosure as 2.71828;
- t is the total charging time of the capacitor in seconds, typically the time constant multiplied by an integer;
- τ (tau) is the time constant in seconds;
- R is the resistance of the charge resistor in ohms; and
- C is the capacitance of the capacitor in farads.

For the system illustrated in FIG. 6, with the capacitors 142 being 10 nF capacitors, the charge resistor 152*a* being 100KΩ, and the supply voltage being 5V, the time constant τ is 1 ms. Based on the knowledge that a capacitor typically reaches its steady state period (~99% of its maximum charge) after 5τ, it can be calculated that the voltage of the capacitor 142 should be about 4.97V after 5 ms. If the measured voltage across a capacitor 142 being sampled is within a threshold of this value (e.g., within 10 percent), it can be assumed that the connection between the capacitor 142 and the charge resistor 152*a* is intact.

It should also be understood that in some embodiments the discharge rate may be defined by the equation:

$$Vc = Vs * e^{(-(t/\tau))}$$

wherein each of the parameters of the equation are as described above.

As a seal strip 100 is used, it undergoes wear. Once the upper surface 106 of the seal strip 100 wears to the extent that the material of the seal strip 100 above the most distant trace 130*a* (i.e., the trace with its run 132 nearest the upper surface of the seal strip 100—see FIG. 6) wears away, the trace 130*a* wears also. Wear of the trace 130*a* breaks the connection between its corresponding capacitor 142*a* and the charge resistor 152*a*. Thus, when the switch 140 samples the connection to the capacitor 142*a*, the measured voltage is outside the acceptable range, thereby indicating that the trace 130*a* has been damaged and, accordingly, wear on the seal strip 100 has reached the depth of the trace 130*a*.

As the seal strip 100 continues to wear, the upper surface 106 wears away until it reaches the run 132 of the second most distant trace 130*b*. Continued wear of the trace 130*b* breaks the connection with its corresponding capacitor 142*b*, which broken connection is detected when the switch 140 tries to connect with the capacitor 142*b*. This process can continue until either (a) all of the traces 130 are broken, or (b) the user chooses to replace the worn seal strip 100 when a particular depth of wear is reached.

Figure 7A:
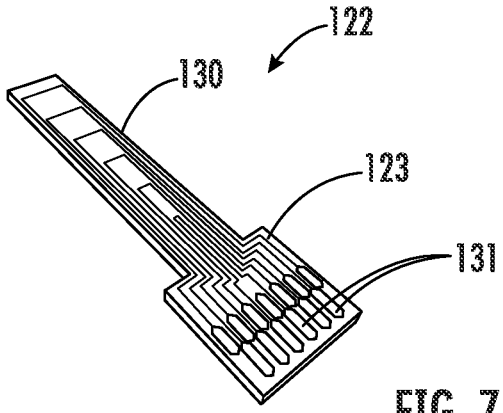
FIGS. 7A-7C are sequential perspective view illustrating the construction of the sensing portion of the wear monitoring system of FIG. 5.
Figure 7B:
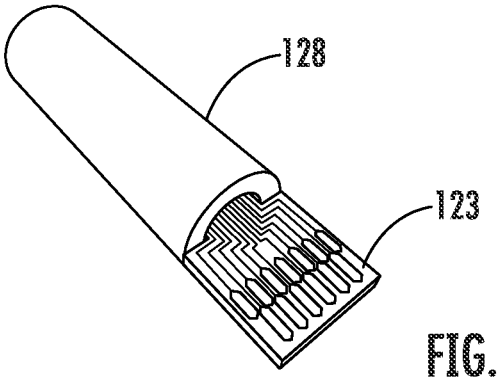
Figure 7C:
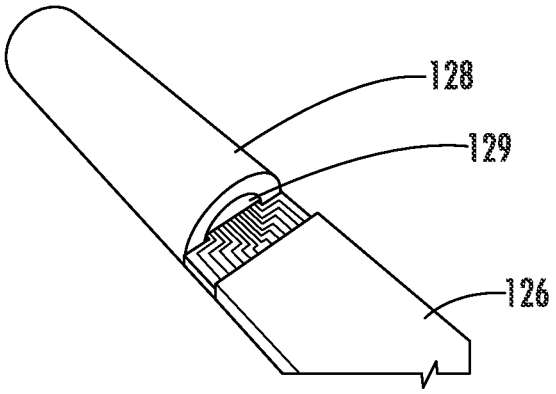

FIGS. 7A-7C illustrate an exemplary configuration and construction for the sensing portion 122. As shown in FIG. 7A, the PCB 123 includes the traces 130 and contact pads 131 for connecting the traces 130 to the signal processing portion 124 via the cables 126. FIG. 7B illustrates the application of the cap 128, which serves to isolate and protect the traces 130. FIG. 7C shows that any space between the cap 128 and the PCB 123 may be filled with a potting compound 129, and also shows the attachment of the cables 126 to the contact pads 131.

Figure 8:
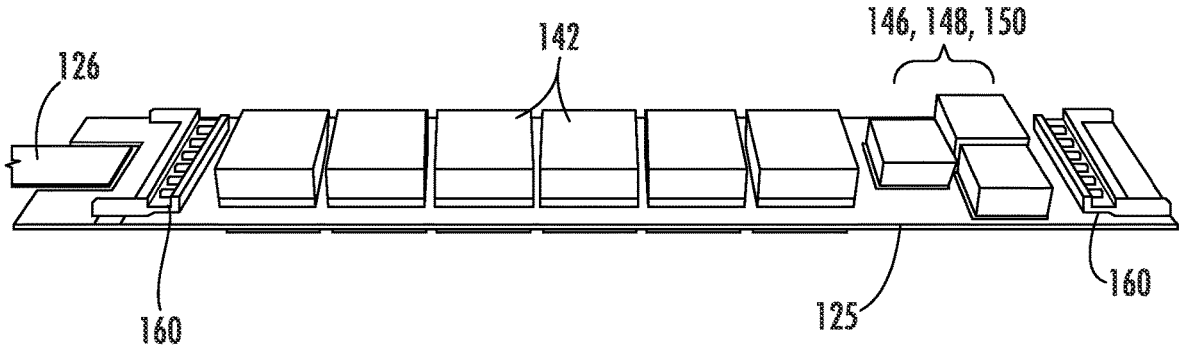
FIG. 8 is a perspective view of electronic components of the wear monitoring system of FIG. 5.

FIG. 8 illustrates an exemplary configuration for the signal processing portion 124. As shown in FIG. 8, the capacitors 142 are mounted on the PCB 125, as is the control circuitry (i.e., the microcontroller 146, the power supply 148, and the communications driver 150). FIG. 8 shows the cable 126 attached to contact pads (not shown) at one end of the PCB 125. Also, connectors 160 are mounted near either end of the PCB 125 to enable the system 120 to be "daisy-chained" to other systems 120 along the length of the seal strip 100, thereby forming an overall assembly that can provide a full-length wear profile of the seal strip 100.

Figure 9:
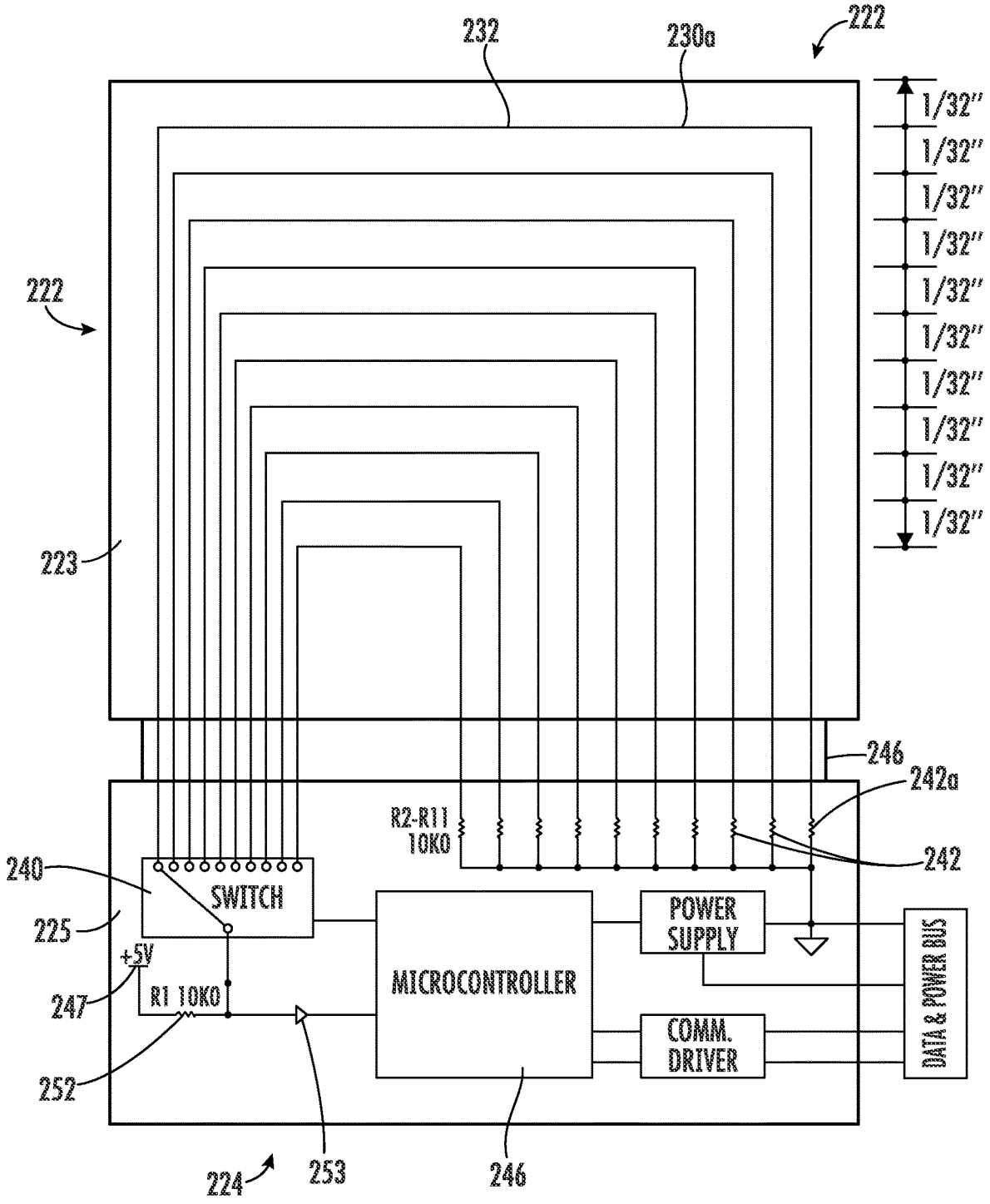
FIG. 9 is a schematic view of a wear monitoring system according to alternative embodiments of the invention.

An alternative embodiment of a wear monitoring system is illustrated in FIG. 9 and designated broadly at 220. The wear monitoring system 220 is similar to the wear monitoring system 120 in that it includes a sensing portion 222 mounted on a PCB 223 with traces 230 and a signal processing portion 224 mounted on a PCB 225, with the sensing portion 222 and the signal processing portion 224 being connected by cables 226. However, the wear monitoring system 220 relies on a plurality of resistors 242 connected to the traces 230 of the sensing portion 222 rather than capacitors. These resistors 242 are connected to ground and to each other in parallel. The detecting circuit mounted on the signal processing portion 224 is slightly different also: the switch 240 is connected directly to the microcontroller 246, and is connected to a resistor 252 that is in turn connected at one end to a voltage supply 247 and at the other end to the microcontroller 246 through a sampling buffer 253.

When the switch 240 connects the resistor 252 with one of the resistors 242, the relationship can be defined as:

$$Vout = Vs\left(\frac{Rs}{Rp + Rs}\right)$$

wherein:

- Vout is the output of the voltage divider in volts with reference to a common ground;
- Vs is the voltage potential of the supply in volts with reference to a common ground;
- Rp is the value of the primary resistor in ohms; and
- Rs is the value of the selected resistor in the resistor bank in ohms.

For the system 220 illustrated in FIG. 9, for a supply voltage of 5V, the resistors 242 being 10 kΩ, and the resistor 252 also being 10 kΩ, the output voltage Vout is half of the supply voltage, or 2.5 V.

As described above, when the seal strip 200 wears during use, eventually the run 232 of the most distant trace 230*a* is reached and damaged. When the switch 240 connects the resistor 242*a* with the charge resistor 252, the voltage should be approximately 2.5V. If this measurement varies more than a certain threshold (e.g., 10%), the system 220 recognizes that such measurement indicates that the seal strip 200 has worn to the depth of the run 232 of the trace 230*a*.

The voltage reading may be either 0V, indicating a short circuit, or 5V, indicating an open circuit. An open circuit indicates that no current is passing through the trace 230*a*, while a short circuit indicates that the electrical trace 230*a* is contacting an outside element, such as lubrication water. Either event indicates that the seal strip 200 has worn down to the level of the trace 230*a*.

As with the wear monitoring system 120, the process is repeated with the other traces 230 until either all of the traces 130 are broken, or the user chooses to replace the worn seal strip 100 when a particular depth of wear is reached.

Figure 10:
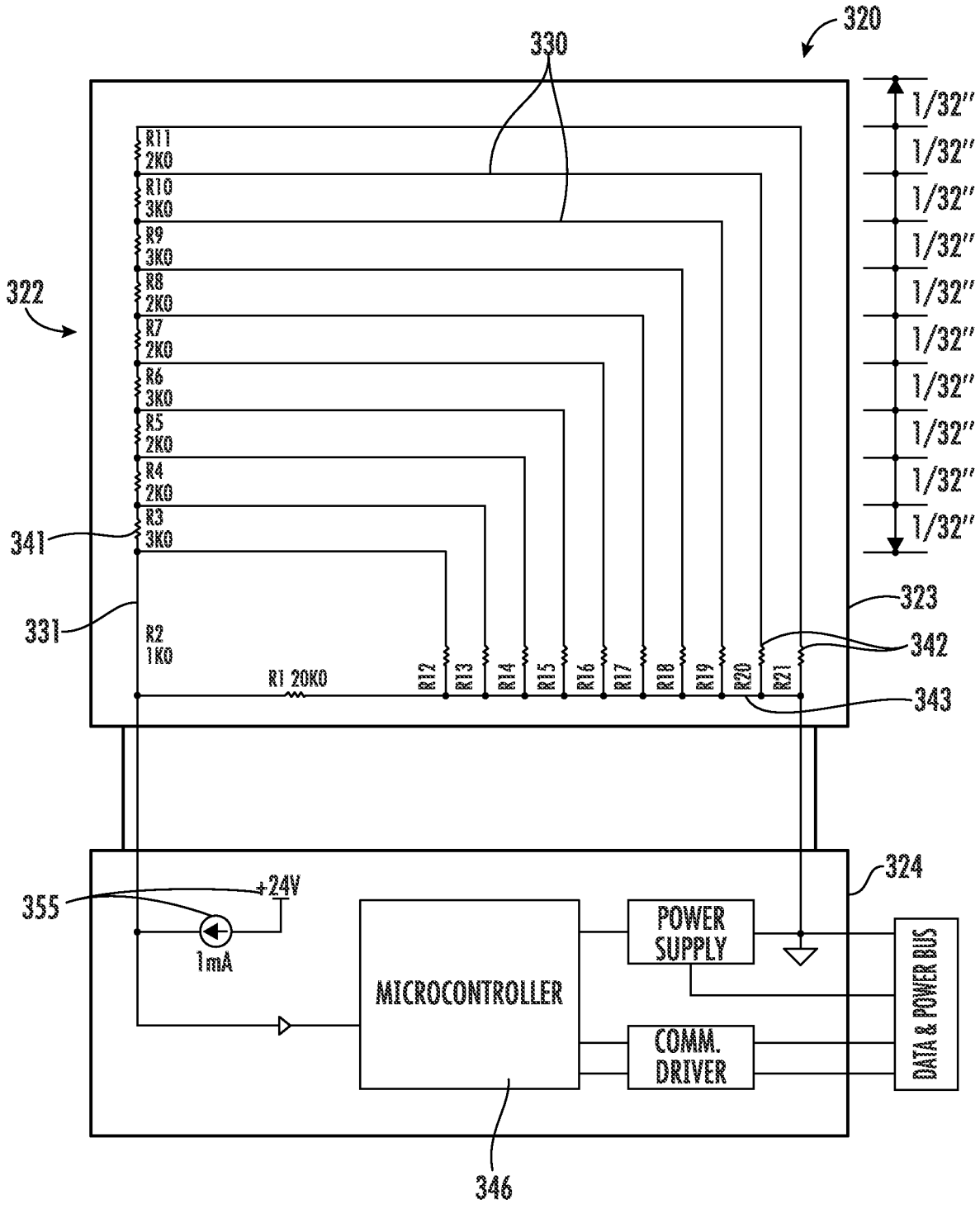
FIG. 10 is a schematic view of a wear monitoring system according to alternative embodiments of the invention.

Another embodiment of a wear monitoring system is shown in FIG. 10 and designated broadly at 320. In this system, the traces 330 of the sensing portion 322 are generally L-shaped. The traces 330 are connected in parallel by a common trace 331 that is then connected with the signal processing portion 324. There is also a resistor 341 positioned on the common trace 331 between each pair of adjacent traces. Resistors 342 that are connected with individual traces 330 are located on the PCB 323 of the sensing portion 322. In this embodiment, the resistors 342 vary in strength. The resistors 342 are connected with each other in parallel by a trace 343 that connects with the trace 331.

The signal processing portion 324 has no switch; instead, the common trace 331 is connected directly to the microcontroller 346 via a trace 357. A constant current source 355 is also connected with the trace 357.

The system 320 relies on Ohm's Law (Voltage=Current*Resistance) for operation. For the resistors 341, which are connected in series, the resistance is $$Rt = R1 + R2 + R3 \ldots + Rn$$

wherein Rt is the total resistance, and the Rn is the resistance of individual resistors. For the resistors 342, which are connected in parallel, the resistance is calculated as $$\frac{1}{Rt} = \frac{1}{R1} + \frac{1}{R2} + \frac{1}{R3} \ldots + \frac{1}{Rn}$$

Thus, because the current is constant, a change in the measured voltage indicates a change in the resistance of the system. Such a change in resistance occurs when a trace 330 is damaged by wear on the seal strip 300.

Using the resistance values shown in FIG. 10, a voltage of approximately 10V is read by the microcontroller 346 when the traces 330 are all intact. As the seal strip 300 wears, an increase of approximately IV is detected for each trace 330 as it wears away.

Those skilled in this art will appreciate that, while voltage and current signals are monitored in the embodiments described above, in other embodiments a combination voltage and current signals may be detected and employed.

Figure 11:
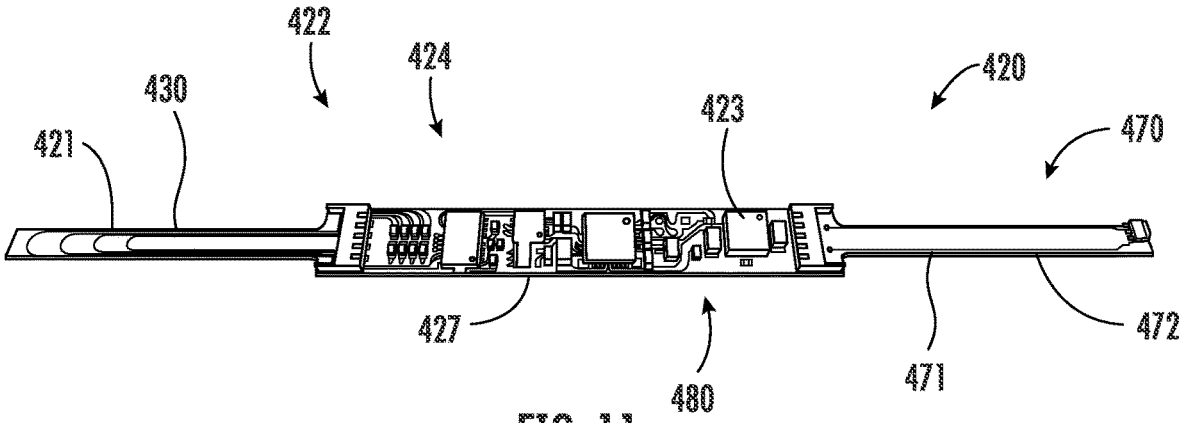
FIG. 11 is a plan view of a seal strip monitoring system according to embodiments of the invention.

FIG. 11 illustrates another wear monitoring system, designated broadly at 420. The wear monitoring system 420 is mounted on a single PCB 423 (i.e., both the sensing portion 422 and the signal processing portion 424 are located on the same PCB 423). As such, there are no cables like cable 126; instead, the traces 430 are connected directly to the components of the signal processing portion 424. The PCB 423 is flexible, enabling it to be bent so that the finger 421 on which the sensing portion 422 is mounted can be oriented generally perpendicularly to the main portion 427 of the PCB 423. Any of the wear monitoring systems 120, 220, 320 described above may be mounted on the PCB 423.

In this embodiment, a temperature monitoring system 470 is also mounted on the PCB 423. The temperature monitoring system 470 may take many forms, including that described in U.S. Provisional Patent Application No. 63/375,587, filed Sep. 14, 2022, the disclosure of which is hereby incorporated herein by reference in full. A sensing portion 472 of the temperature monitoring system 470 is mounted on finger 471 of the PCB 423, and signal processing components of the temperature monitoring system 470 are mounted on the main portion 427 of the PCB 423. Together the wear monitoring system 420 and the temperature monitoring system 470 form an overall seal strip monitoring system 480.

Figure 12A:
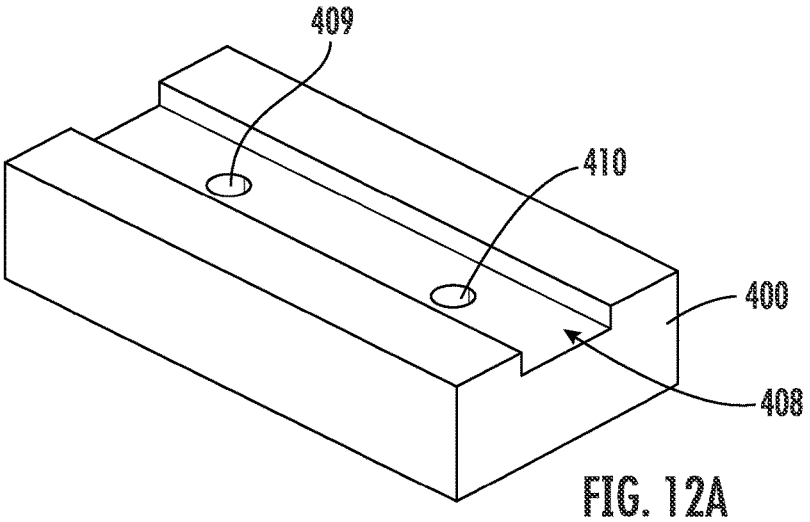
FIGS. 12A-12D are sequential perspective views illustrating the construction of the seal strip monitoring system of FIG. 11.
Figure 12B:
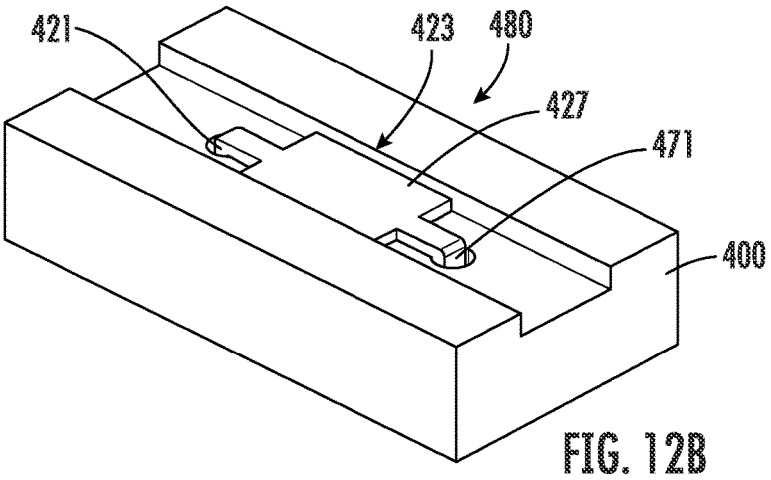
Figure 12C:
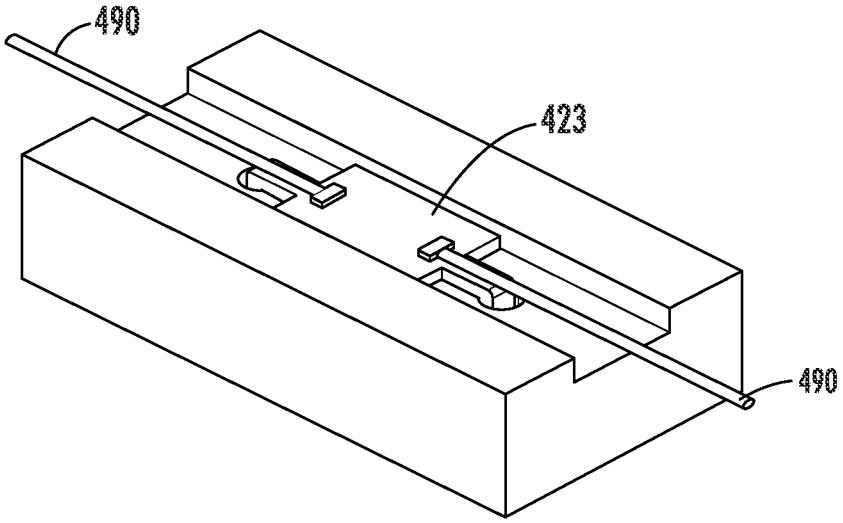
Figure 12D:
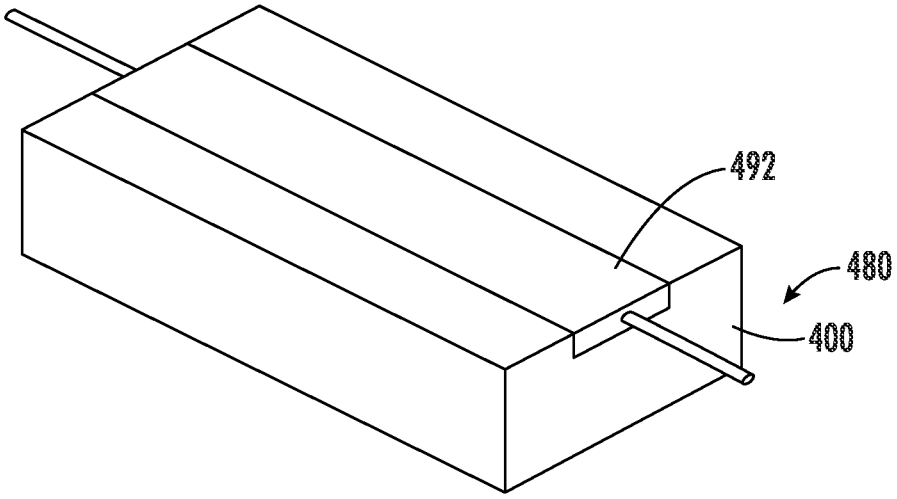

Mounting of the seal strip monitoring system 480 is illustrated in FIGS. 12A-12D. FIG. 12A illustrates the lower surface of a seal strip 400, wherein a channel 408 has been formed and holes 409, 410 have been drilled perpendicularly to the channel 408. FIG. 12B illustrates that the system 480 is installed in the seal strip 400, with the fingers 421, 471 inserted into the holes 409, 410 to deploy the sensing portions 422, 472, and the main portion 427 of the PCB 423 mounted in the channel 408 itself. FIG. 12C illustrates the connection of cables 490 to the PCB 423 to allow for the aforementioned "daisy-chaining" of systems 480 along the length of the seal strip 400. FIG. 12D illustrates that potting compound 492 (e.g., an elastomeric silicone) is added to fill in the channel 408.

It should also be noted that any of the seal strips discussed herein may employ different components for performing different functions. For example, the load tubes may be replaced with other components (e.g., springs, resilient pads, or the like) that bias the seal strips toward the shell of the suction roll. The seal strip holder may take different configurations. Other variations may also be employed.

Figure 13:
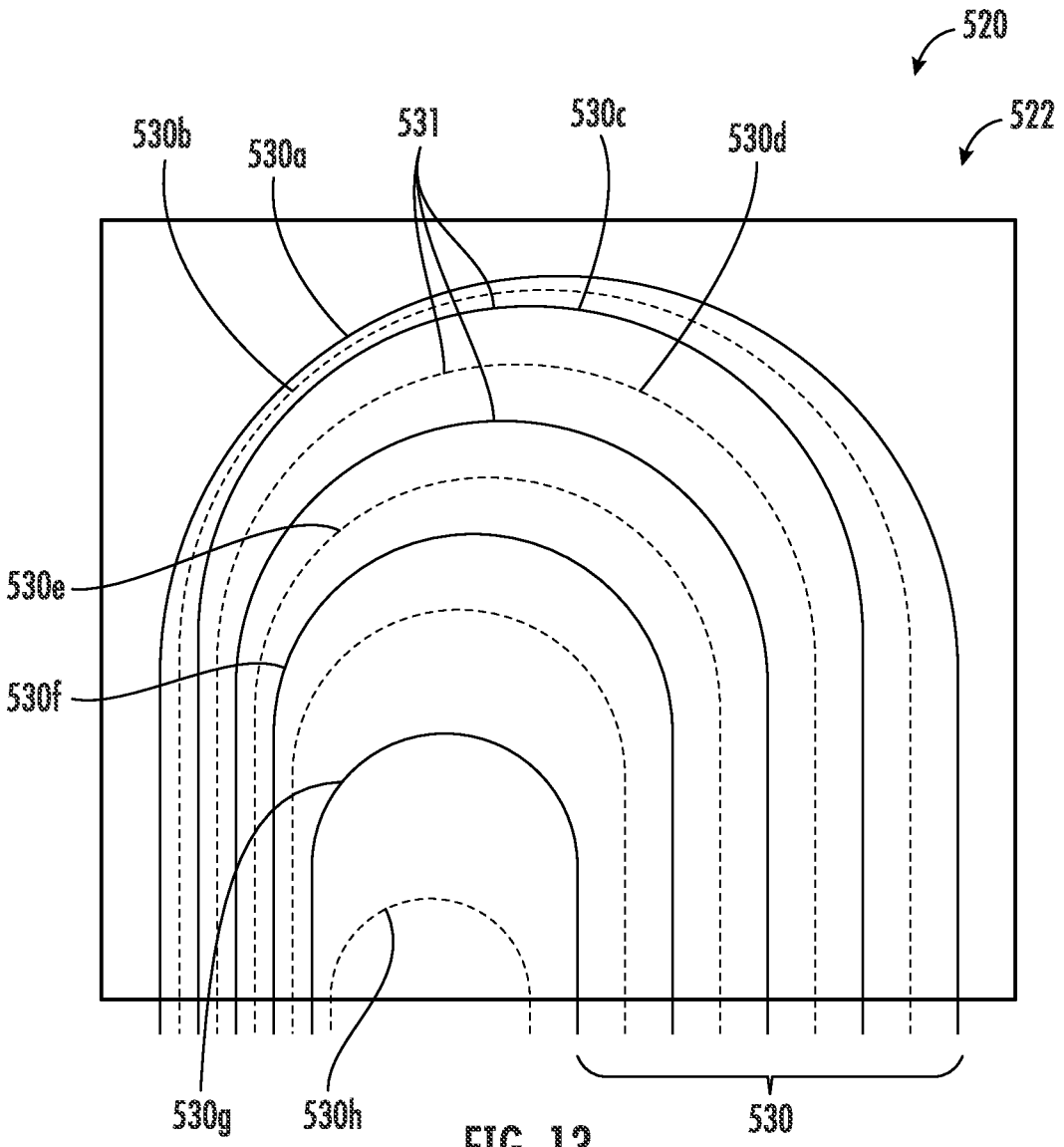
FIG. 13 is a schematic view of a wear monitoring system according to further embodiments of the invention.

One further variation of a wear monitoring system is shown in FIG. 13 and designated broadly at 520. The sensing portion 522 includes a plurality of traces 530. The traces 530 differ from those shown in the wear monitoring systems 120. 220, 320, 420 in that (a) the traces 530 describe an arcuate path at their upper end portions, and (b) the uppermost portions 531 of the traces 530 are separated from each other in a non-uniform manner. More specifically, a first distance between the uppermost portions of the upper traces (e.g., traces 530*a*, 530*b*) is much smaller than a second distance between the lower traces 530 (e.g., traces 530*g*, 530*h*). In the embodiment illustrated in FIG. 13, the intermediate traces 530 (traces 530*c*, 530*d*, 530*e*, 530*f*) are separated by one or more distances that differ from both the first and second distances. In other words, the distance between the upper ends of adjacent traces 530 increases with distance from the upper surface of the seal strip 500, with the proviso that in some cases the distance from the upper end of one trace 530 to the upper ends of its adjacent traces 530 may be the same (e.g., the distance between (i) traces 530*a* and 530*b* and (ii) traces 530*b* and 530*c* may be the same).

Also, in the illustrated embodiment the traces shown in solid line (i.e., 530*a*, 530*c*, 530*e*, 530*g*) are positioned on one side of a PCB, and the traces shown in broken line (i.e., 530*b*, 520*d*, 530*f*, 530*h*) are positioned on the opposite side of the PCB. This arrangement can help to keep traces that are near each other separated.

Those of skill in this art will appreciate that the sensing portion 522 of the wearing monitoring system 520 may be connected with a signal processing portion that is similar to any of the signal processing portions 124, 224, or 324 with respect to the location of resistors and/or capacitors.

This arrangement of traces 530 may provide a user with certain flexibility of use. Having the upper portions of the traces 530 closer together near the surface of the seal strip can enable the user to detect initial wear very accurately. The user may choose to act immediately upon the detection of wear (e.g., by replacing the seal strip 500). In contrast, if initial wear is of less concern to the user, the more widely-spaced traces 530 that are located farther from the upper surface can provide a "fail-safe" level of detection in the case in which more wear is acceptable.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

What is claimed is:

1. A seal strip and wear monitoring system, comprising:
a seal strip having an upper surface; and
a wear monitoring system, comprising:
a sensing portion comprising a plurality of electrical traces, each of the electrical traces including an uppermost portion that is positioned at a depth from the upper surface of the seal strip, wherein the depth of each trace uppermost portion differs from the depth of the uppermost portions of the other electrical traces; and
a signal processing portion electrically connected with the electrical traces, the signal processing portion including circuitry configured to detect electrical signals from the traces and to determine when the uppermost portion of a trace has been damaged;
wherein the signal processing portion comprises a plurality of capacitors, each connected with a respective electrical trace.

2. The system of claim 1, wherein the signal processing portion comprises a plurality of resistors, each connected with a respective electrical trace.

3. The system of claim 2, wherein each of the resistors has the same resistance.

4. The system of claim 2, wherein each of the resistors has a different resistance.

5. The system of claim 1, wherein the detected electrical signals are voltage signals.

6. The system of claim 1, wherein the detected electrical signals are current signals.

7. The system of claim 1, wherein the uppermost portions of the electrical traces are regularly spaced from each other.

8. The system of claim 1, wherein the uppermost positions of the electrical traces are non-uniformly spaced from each other.

9. The system of claim 1, wherein the sensing portion and the signal processing portion are disposed on a common printed circuit board (PCB).

10. The system defined in claim 9, further comprising a temperature sensing system disposed on the common PCB.

11. The system defined in claim 9, wherein the uppermost portions of the electrical traces are disposed on a finger of the common PCB, the circuitry is disposed on a main portion of the PCB, and the finger is generally normal to a plane defined by the main portion.

12. The system defined in claim 1, wherein each uppermost portion is generally parallel with each of the other uppermost portions.

13. The system defined in claim 1, wherein each uppermost portion is arcuate.

14. A seal strip monitoring system, comprising:
a seal strip having an upper surface;
a printed circuit board (PCB) having first and second fingers and a main panel;
a wear monitoring system, comprising:
a sensing portion comprising a plurality of electrical traces, each of the electrical traces including an uppermost portion that is generally parallel with and is positioned at a depth from the upper surface of the seal strip, wherein the depth of each trace uppermost portion differs from the depth of the uppermost portions of the other electrical traces;
wherein the uppermost portions of the electrical traces are located on the first finger;
a signal processing portion electrically connected with the electrical traces, the signal processing portion including circuitry mounted on the main panel of the PCB and configured to detect electrical signals from the traces and to determine when the uppermost portion of a trace has been damaged, wherein the signal processing portion comprises a plurality of capacitors, each connected with a respective electrical trace; and
a temperature monitoring system at least partially mounted on the PCB.

15. The seal strip monitoring system of claim 14, wherein the first and second fingers are disposed generally parallel to the main portion of the PCB.

16. The seal strip monitoring system of claim 14, wherein the temperature monitoring system is at least partially mounted on the second finger.

17. The seal strip monitoring system of claim 14, wherein the uppermost portions of the electrical traces are regularly spaced from each other.

18. The seal strip monitoring system of claim 14, wherein the uppermost positions of the electrical traces are non-uniformly spaced from each other.

19. The seal strip monitoring system of claim 14, wherein each uppermost portion is arcuate.

20. A seal strip and wear monitoring system, comprising:
a seal strip having an upper surface; and
a wear monitoring system, comprising:
a sensing portion comprising a plurality of electrical traces, each of the electrical traces including an uppermost portion that is positioned at a depth from the upper surface of the seal strip, wherein the depth of each trace uppermost portion differs from the depth of the uppermost portions of the other electrical traces; and a signal processing portion electrically connected with the electrical traces, the signal processing portion including circuitry configured to detect electrical signals from the traces and to determine when the uppermost portion of a trace has been damaged;

wherein the sensing portion and the signal processing portion are disposed on a common printed circuit board (PCB).

* * * * *